United States Patent [19]

Antonides

[11] Patent Number: 4,696,250

[45] Date of Patent: Sep. 29, 1987

[54] PORTABLE BOAT RAMP FOR SMALL WATERCRAFT

[76] Inventor: John E. Antonides, 1834 W. Kerry La., Phoenix, Ariz. 85027

[21] Appl. No.: 757,482

[22] Filed: Jul. 22, 1985

[51] Int. Cl.[4] ..... B63B 17/00

[52] U.S. Cl. ..... 114/343; 114/344; 405/1

[58] Field of Search ..... 114/343, 344, 44–48; 405/1–5, 7; 248/156; 280/414.1

[56] References Cited

U.S. PATENT DOCUMENTS

| | | | |
|---|---|---|---|
| 2,658,354 | 11/1953 | Lee | 405/1 |
| 3,055,022 | 9/1962 | Vallquist | 405/1 X |
| 3,177,668 | 4/1965 | Schneider et al. | 405/3 |
| 3,579,996 | 5/1971 | Edson | 405/1 |
| 3,721,096 | 3/1973 | Derkert, Jr. et al. | 405/7 |
| 3,984,121 | 10/1976 | Dobosi | 280/414.1 |
| 4,260,282 | 4/1981 | Dorsey et al. | 405/1 |

FOREIGN PATENT DOCUMENTS

| | | | |
|---|---|---|---|
| 601052 | 6/1978 | Switzerland | 280/414.1 |

*Primary Examiner*—Jeffrey V. Nase
*Assistant Examiner*—Paul E. Salmon
*Attorney, Agent, or Firm*—Gregory J. Nelson

[57] ABSTRACT

A portable boat ramp having a frame supporting a cradle having protective support pads thereon. The frame also includes ground stakes for securing the ramp in a temporary position on the waterbed. A boat may be temporarily moored with the forward portion of the hull in the cradle in a position near the shoreline but with the boat out of contact with the waterbed, thus preventing damage to the boat hull from such contact and the buffeting and wave action normally encountered when the boat is beached.

5 Claims, 8 Drawing Figures

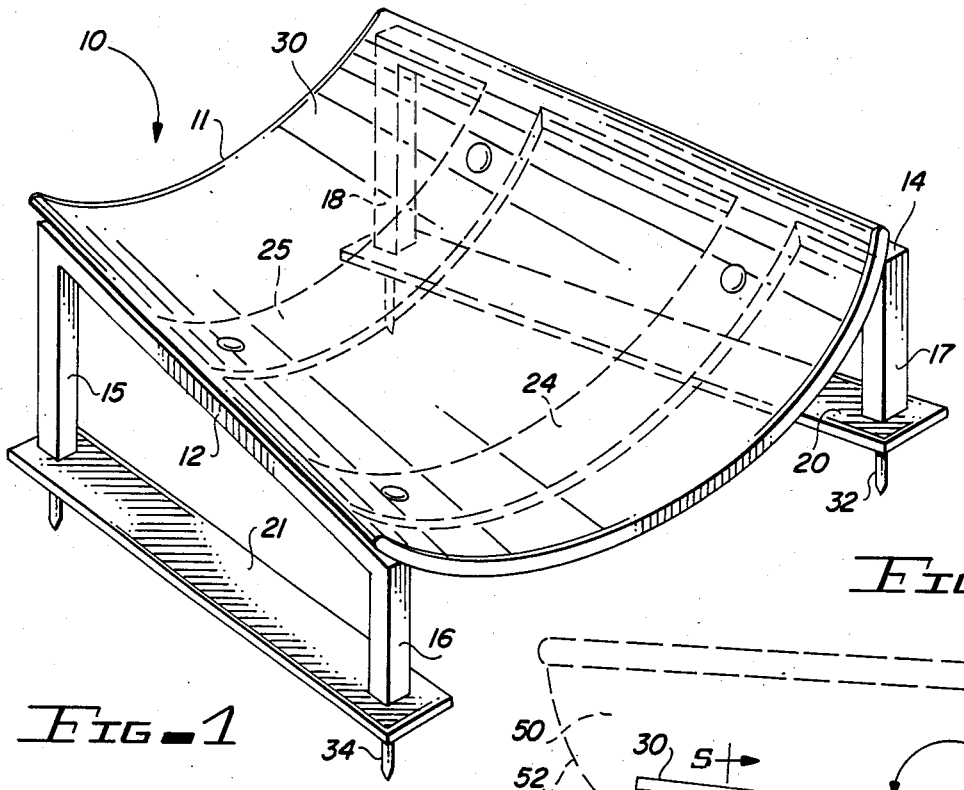
FIG. 1
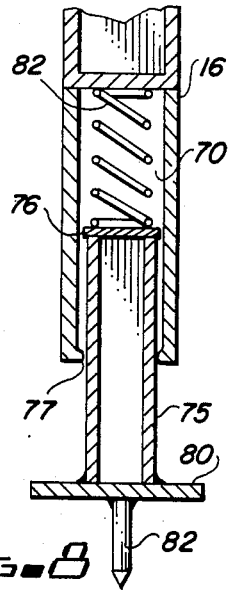
FIG. 8
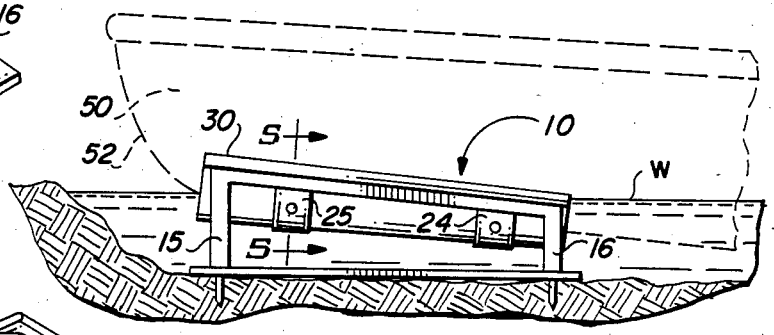
FIG. 2
FIG. 3
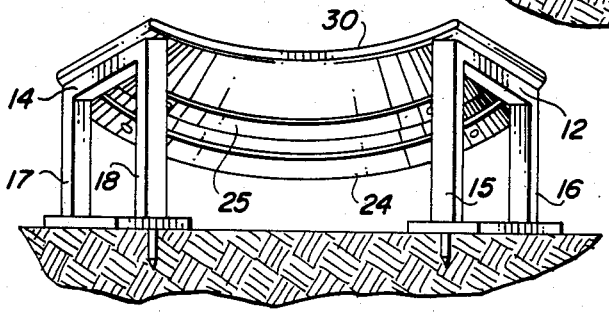
FIG. 4
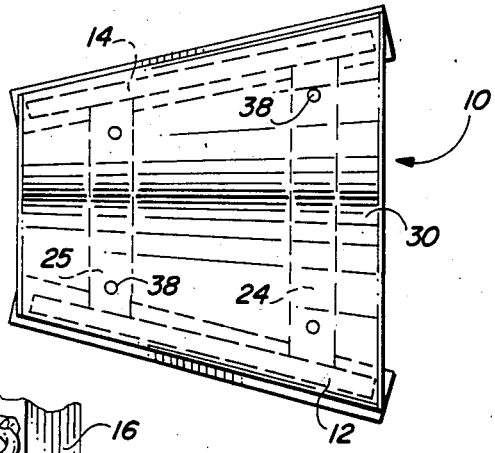
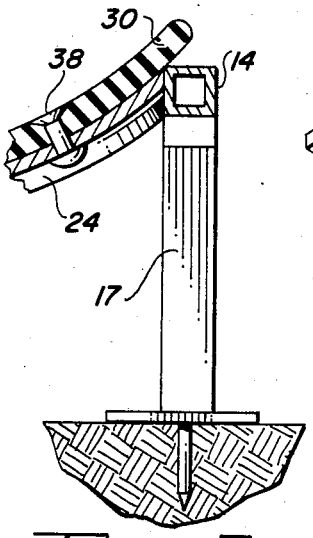
FIG. 5
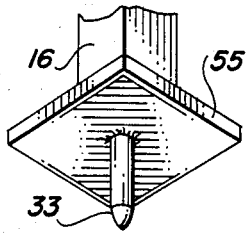
FIG. 6
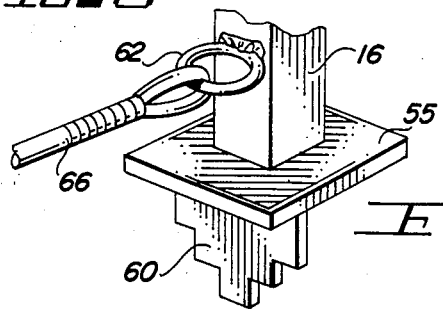
FIG. 7

PORTABLE BOAT RAMP FOR SMALL WATERCRAFT

The present invention relates to boat ramps and more particularly relates to an improved portable boat ramp for small watercraft for supporting watercraft in a beached position with the hull out of contact with the waterbed.

Generally it is the practice of small watercraft operators to either moor a boat at a suitable mooring facility or, if, none is available, beach the boat at the shoreline by running the hull onto the shoreline a sufficient distance to accomodate boarding or disembarking. This procedure has certain significant disadvantages. Not infrequently, the waterbed is irregular and sloping and presents various hazards such as rocks and the like. Once the boat is beached in conventional manner, the boat is often subject to buffeting by turbulent water conditions prevalent along the shore areas due to currents, waves, swells and the like. The buffeting can cause serious damage to the boat hull in a short period of time, particularly if rocks or other hazards are present. Even if the damage does not structurally affect the integrity of the boat, such damage is aesthetically undesireable as scratches and mars can detract from the overall appearance of the boat and can also diminish the value of the watercraft.

Various types of mooring devices can be found in the prior art. Generally, these devices are floatation docking facilities for supporting watercraft out of contact with the water when the craft is not in use and which permits the watercraft to be lowered for use. Such devices generally include a pump and suitable valving to regulate the buoyancy of the device. The pontoons serve as ballast tanks and may be selectively filled with air for raising or elevating the frame or charged with water so that the facility may be submerged. However, these devices are not particularly portable and would not lend themselves to use as a portable boat ramp when temporarily beaching the boat and would not serve to effectively solve the problem of hull damage when beaching watercraft.

Briefly, in accordance with the present invention, a simple, rugged, inexpensive and portable boat ramp for small watercraft is provided which supports the craft out of contact with the waterbed when the boat is temporarily beached. The portable boat ramp of the present invention includes a frame of a suitable corrosion resistant material which supports an arcuate cradle of resilient or protective material. The frame includes downwardly projecting ground stakes or anchors which serve to engage the waterbed and position the cradle in a location to receive the hull of the boat and support it at the shoreline with the hull out of contact with the waterbed. The ramp is positioned close enough to the shoreline to provide easy boarding and disembarking from the watercraft. The device may include an anchor line to secure the portable boat ramp to the boat. In an alternate embodiment, the supporting legs include internal shock absorbers to assist in absorbing buffeting and absorb shock as the boat is driven onto the portable ramp. When not in use, the device is portable and may be conveniently stored in the boat.

Accordingly, it is the main object of the present invention to provide a simple, rugged inexpensive and portable boat ramp for small watercraft, operable to temporarily support such craft out of contact with the waterbed in a beached position.

It is another object of the present invention to provide an improved portable boat ramp for small watercraft which prevents damage to the hull of the boat normally occurring when the boat is beached or subject to turbulence or buffeting when in a beached position.

The above and other objects of the present invention will become more apparent in connection with the following specification and claims in connection with the accompanying drawings in which:

FIG. 1 is a perspective view of the portable boat ramp of the present invention;

FIG. 2 is a side elevational view of the boat ramp of the present invention shown in a position of use at the shoreline with a typical boat hull shown positioned therein;

FIG. 3 is a front view of the ramp of the present invention;

FIG. 4 is a top view of the boat ramp of the present invention;

FIG. 5 is a partial sectional view taken along lines 5—5 of FIG. 2;

FIG. 6 is a detail perspective view of an alternate construction of a portion of the frame of the ramp;

FIG. 7 is a perspective view of another alternate frame construction; and

FIG. 8 is a cross-sectional view of still another leg construction for the boat ramp incorporating shock absorbing means.

Referring to the drawings, particularly FIGS. 1 to 5, there is shown a preferred embodiment of the portable boat ramp designated generally by the numeral 10. Ramp 10 has a frame formed of suitable corrosion resistant material including opposite side rail members 12 and 14 which slightly converge forwardly toward one another. The "forward" or front of the device is indicated by the numeral 11. Vertically depending legs 15, 16 are provided opposite ends of rail 12. Similarly, legs 17 and 18 extend downwardly at opposite ends of rail 14. Legs 15 and 18 are located at the forward end of the ramp legs 16 and 17 at the rear. Preferably, legs 16 and 17 are slightly shorter than legs 15 and 18 giving the ramp a forward incline. Base plate 20 extends longitudinally between the lower ends of legs 17 and 18 and base plate 21 extends longitudinally between the lower end of legs 15 and 16. Arcuate saddle brackets 24, 25 extend transversely between rail members 12 and 14 and support a cradle 30 which is preferably of a resilient material such as rubber, plastic or other similar material. The cradle may be secured to the bracket by recessed fasteners 38 as shown in FIG. 5.

Ground stakes 32 project downwardly at opposite ends of bearing plate 20. Another pair of ground stakes 34 project downwardly from the opposite ends of bearing plate 21.

As mentioned above, the frame may be made of any suitable material which will resist corrosion such as formed from structural iron welded together and coated with suitable material such as galvanizing. Various other materials and coating compositions can be used such as epoxy resins and the like to protect the frame from corrosion due to contact with either salt or fresh water. Other materials such as aluminum may be used and provide the added advantage of lighter weight since the ramp is designed to be portable.

In use, the portable ramp 10 may be conventionally stowed on-board the boat. The device is compact and typically need only be approximately 18" inches wide and 24" inches long so it may be conveniently stowed on-board. When the operator wishes to beach and maintain the boat in a position in the water near shore, ramp 10 is removed from storage and placed in a proper location adjacent the shoreline. The particular location will vary with the contour of the shoreline, but generally the device is placed so it is just partly submerged beneath waterline W as shown in FIG. 2. If the shore is rocky, groundstakes 32 and 34 will tend to wedge between the rocks and secure the device in place. If the shoreline is sandy, the bearing plates 20 and 21 will tend to distribute the load and prevent the device from sinking in the sand.

With the ramp positioned as shown in FIG. 2, the boat 50 then may be manually pulled into position onto the ramp with the bow 52 of the boat 50 resting or nesting in the ramp. If the boat is a motorboat, the boat may be motored onto the ramp. In this position, the boat is adjacent the shoreline but the bow and hull of the boat are out of contact with the shoreline. The soft, resilient pad 30 prevents damage to the hull. When the boat is to be launched, the boat may be simply manually pushed away from the ramp and the ramp retrieved and suitably stowed on the boat.

FIG. 6 illustrates an alternate embodiment of the present invention in which the legs of the frame are slightly modified. Leg 16 is shown as being representative of legs 15, 17, and 18. In this embodiment, the bearing plate has been replaced in favor of a generally rectangular pad 55 which serves to support the load imposed on the ramp. A ground stake 33 again projects downwardly to serve to stabilize the ramp in position by engaging the waterbed.

FIG. 7 shows an alternate embodiment in which the leg 16 and pad 55 are as shown in FIG. 6. The configuration of the ground stake has been slightly modified having a generally exterior sawtooth configuration 60 which for some applications will better engage the waterbed. In addition, a loop 62 is welded to leg 16 for attachment of an anchor line 66 the opposite end of which may be suitably secured to an object on the shoreline to prevent the ramp from being inadvertantly lost in the water when not in use. Further, line 66 provides a convenient means of retrieving the ramp once the boat is disengaged from the ramp as the device can simply be hauled on-board by means of line 66.

FIG. 8 shows another modification in which leg 16 is again shown as being representative of all of the legs of the frame. Leg 16 is shown as defining the internal chamber 70 which receives reciprocal piston member 75. Reciprocal member 75 has a flange 76 at its upper end which engages a lip 77 at the bottom end of chamber 70 which limits the travel of member 75. The lower end of member 75 is provided with a ground pad 80. A compression spring 82 extends within chamber 70 between members 75 and transverse wall member 86 at the upper end of chamber 70 and the combination of springs 82 are of sufficient stiffness to support the boat in normal conditions. In this configuration, the pistons 75 will reciprocate to serve as shock absorbers to absorb shock imposed on the device due to heavy buffeting of a boat on the ramp or due to a boat under motor being driven onto the ramp.

From the foregoing, it will be seen that the present invention provides a novel, portable boat ramp which is simple, rugged and can be inexpensively manufactured. The device is portable and can be easily stowed on the watercraft and is suitable for use with both power boats and sailboats. While the particular portable boat ramp for small craft is shown and disclosed in detail herein, it is understood that the foregoing disclosure is merely illustrative of the presently preferred embodiment of the invention. Accordingly, it will be apparent to those skilled in the art to make various changes, alterations and modifications to the invention disclosed herein, to the extent that those changes, alterations and modifications do not depart from the spirit and scope of the appended claims. They are intended to be encompassed therein.

I claim:

1. A portable and temporary ramp for small watercraft for supporting the hull of a boat in a position out of contact with the waterbed, said ramp comprising:

(a) a frame having a front and rear having an opposite spaced-apart pair of rails generally forwardly inclined and convergent, said frame further including at least one transverse member extending between said rails forming a cradle, and legs depending from said rails at opposite ends thereof;

(b) protective means associated with said cradle defining a generally transversely curved saddle having an upper surface, said upper surface being substantially coextensive with said rails and extending substantially the length thereof and occupying substantially the entire area between said rails, said upper surface being substantially free of obstruction and generally forwardly inclined and converging and extending longitudinally a distance corresponding to a portion of the bow of the boat whereby boats of various hull sizes and configurations will seat in a supported position on said saddle out of contact with the waterbed;

(c) bearing pad means associated with the lower end of said leg means, said bearing pad means being generally perpendicular to said leg means and adapted to engage a surface area of the waterbed to distribute the load thereon and to stabilize the ramp in position on the waterbed; and (d) ground engaging means extending from at least one of said bearing pad means for anchoring the ramp whereby said ramp can be conveniently stored as a unit in said boat and when desired, anchored in at least a partially submerged position to support a forward portion of the boat hull in an out-of-contact position with the waterbed.

2. The ramp of claim 1 further including means for attaching a line thereto.

3. The ramp of claim 1 wherein said ground engaging means comprises at least one downwardly projecting rod-like member.

4. The ramp of claim 1 wherein said ground engaging means comprises at least one downwardly depending plate having one or more lateral projections.

5. The ramp of claim 1 wherein said frame includes downwardly extending legs having shock absorbing means.

* * * * *